US006905319B2

(12) United States Patent
Guo

(10) Patent No.: US 6,905,319 B2
(45) Date of Patent: Jun. 14, 2005

(54) STATOR FOR DOWN HOLE DRILLING MOTOR

(75) Inventor: Lillian Guo, Sugarland, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 145 days.

(21) Appl. No.: 10/059,829

(22) Filed: Jan. 29, 2002

(65) Prior Publication Data

US 2003/0143094 A1 Jul. 31, 2003

(51) Int. Cl.[7] ..... F03C 2/08
(52) U.S. Cl. ..... 418/48; 418/153
(58) Field of Search ..... 418/48, 153

(56) References Cited

U.S. PATENT DOCUMENTS

| | | | | |
|---|---|---|---|---|
| 1,892,217 A | | 12/1932 | Moineau | |
| 3,607,981 A | | 9/1971 | Morris | 260/879 |
| 3,840,080 A | | 10/1974 | Berryman | 175/107 |
| 3,912,426 A | | 10/1975 | Tschirky | 418/48 |
| 4,008,190 A | | 2/1977 | Taylor et al. | 260/5 |
| 4,185,839 A | | 1/1980 | Allen | 277/105 |
| 4,259,460 A | | 3/1981 | Schwarz | 525/208 |
| 4,415,316 A | | 11/1983 | Jürgens | 418/48 |
| 4,546,130 A | | 10/1985 | Mishida et al. | 523/459 |
| 4,588,309 A | | 5/1986 | Uyehara et al. | 384/94 |
| 4,614,779 A | | 9/1986 | Watanabe et al. | 525/199 |
| 4,631,309 A | | 12/1986 | Thörmer et al. | 524/426 |
| 4,636,151 A | | 1/1987 | Eppink | 418/48 |
| 4,688,605 A | | 8/1987 | Eisenzimmer et al. | 138/130 |
| 4,820,764 A | | 4/1989 | Guzy et al. | 524/512 |
| 4,913,234 A | | 4/1990 | Bodine | 166/301 |
| 4,914,160 A | | 4/1990 | Aziaian | 525/329.3 |
| 5,090,497 A | | 2/1992 | Beimgraben et al. | 175/107 |
| 5,171,138 A | | 12/1992 | Forrest | 418/48 |
| 5,171,139 A | * | 12/1992 | Underwood et al. | 418/48 |
| 5,417,281 A | | 5/1995 | Wood et al. | 166/68 |
| 5,620,313 A | | 4/1997 | Fockenberg | 417/475 |
| 5,759,109 A | | 6/1998 | Martini | 473/200 |
| 5,912,303 A | | 6/1999 | Nakahama et al. | 525/237 |
| 6,183,226 B1 | | 2/2001 | Wood et al. | 418/48 |
| 6,191,510 B1 | | 2/2001 | Landin et al. | 310/51 |
| 6,251,493 B1 | | 6/2001 | Johnson et al. | |

FOREIGN PATENT DOCUMENTS

| | | | |
|---|---|---|---|
| CA | 2058080 | | 11/1997 |
| DE | 32 26 081 C1 | | 12/1983 |
| GB | 123837 | | 3/1919 |
| GB | 2297092 | * | 7/1996 |
| WO | WO 01/77185 A1 | | 10/2001 |

OTHER PUBLICATIONS

Internet: http://www.zeon.co.jp/business_e/enterprise/rubber/rubber_nbr.html; note "Nipol (RTM) NBR" (Medium High Nitrile Rubber); type N32 has ACN 33.5% and Mooney viscosity of 46%, type N33 has 33.5% and Mooney viscosity of 51%.

Internet: http://www.nantex.com.tw/e/p07–06–07.html; note eg Nancar (RTM) 1052 has ACN 33% and Mooney viscosity of 52 and Nancar (RTM) 3645 has ACT 36% and Mooney viscosity of 45.

(Continued)

*Primary Examiner*—John J. Vrablik
(74) *Attorney, Agent, or Firm*—Fish & Richardson P.C.

(57) ABSTRACT

An improved down hole drilling motor suitable for drilling applications. The down hole drilling motor comprising a stator disposed in the tubular housing. The stator includes an internal cavity having one or more lobes. A rotor operatively positioned in the cavity of the stator is adapted to cooperate with the one or more lobes of the stator. The stator comprising a compound having improved manufacturing and performance characteristics.

20 Claims, 1 Drawing Sheet

OTHER PUBLICATIONS

Internet: http://www.astlettrubber.com/pdf/sr/nbrb6250.pdf; note NBR B6250 eg for "oil field products" has ACN 34% and Mooney viscosity of 50.

Internet: http://www.nitriflex.com.br/eng/template.asp?pag=produtos_01_01; note Nitriflex (RTM) N–685 has ACN 33% and Mooney viscosity of 50.

Internet: http/www.rubber.bayer.de/english/wgrp/prod–dat/fke/over3al.htm; note Bayer AG Krynac (RTM) and Perbunan (RTM) rubbers, eg Krynac 34.50 (33% ACN, 45±5 Mooney); Krynac VP KA 8699 (33% ACN, 45±7 Mooney), Perbunan NT 3445 (34±1% ACN, 45± Mooney); Perbunan NT 3446 (34.7±1% ACN, 45–35 Mooney); Perbunan NT 34.45 S (34% ACN, 45±5 Mooney).

Internet: https://www.rubber.bayer.com/bro/literature.nsf/0/F09AB725918C533 4C1256BE2002E8C92/$File/34381.pdf?Open Element; note NB Bayer Therban (RTM) VP KA 8837 (34% ACN, 55 Mooney); Therban (RTM) HT VP KA 8805 (34% ACN, 45 Mooney).

Great Britain Search Report, Examiner John Twin; dated Jul. 21, 2003.

Annual Book of ASTM Standards; "*Standard Test Method for Rubber Property–Effect of Liquids*[1]"; Last previous edition D471–95; pp. 86–96.

Annual Book of ASTM Standards; "*Standard Test Methods for Rubber–Viscosity, Stress Relaxation, and Pre–Vulcanization Characteristics* (*Mooney Viscometer*)[1]"; Last previous edition D1646–96; pp. 313–322.

Annual Book of ASTM Standards; "*Standard Test method for Rubber Property—Durometer Hardness*[1]"; Last previous edition D2240–91, pp.400–403.

Alicia Dalton; "*Advanced Smart Drilling Systems*"; Deep Trek Workshop; Presented at the Hotel Sofietel; Houston, Texas; Mar. 20–21, 2001; pp. i–32.

DSM; "*DSM Elastomers*"; www/dsmna.com/companies/copolymer.html; Oct. 3, 2001; 1 page.

Bayer Therban (RTM) brochure: https://www.rubber.bayer.com/bro/literature.nsf/0/F09AB725918C5334C1256BE2002E8C92/$File/34381.pdf?OpenElement; see eg the table on p. 6 and the diagram at the top of p. 9.

* cited by examiner

STATOR FOR DOWN HOLE DRILLING MOTOR

FIELD OF THE INVENTION

This invention is directed generally toward down hole motors, and in particular down hole drilling motors used in oil and gas well drilling applications and the like.

BACKGROUND OF THE INVENTION

Progressing cavity motors, also known as Moineau-type motors (after the inventor of U.S. Pat. No. 1,892,217), including stator devices used therein, have been used in drilling applications for many years. See, for example, the following U.S. Pat. Nos. which are incorporated herein by reference: U.S. Pat. Nos. 3,840,080; 3,912,426; 4,415,316; 4,636,151; 5,090,497; 5,171,138; 5,417,281; 5,759,109; and 6,183,226.

Conventional Moineau pump and motor art has used rubber or elastomer materials bonded to steel for the stator contact surface. Such elastomers include not only natural rubber, but also synthetics, such as G.R.S., Neoprine, Butyl and Nitrile rubbers and other types such as soft PVC. For example, U.S. Pat. No. 5,912,303, incorporated herein by reference, discloses a polyene terpolymer rubber composition that is vulcanized for applications in the automotive industry. EPDM, a terpolymer, is highly resistant to weather, ozone and heat aging but is not oil resistant. The '303 patent teaches blending nitrile rubber (NBR), which is oil resistant, with EPDM to obtain the advantages of both NBR and EPDM. The rubber is vulcanized and then used in tires, hoses, windshield wipers and the like that are subjected to weather and the like.

Rubber stators in down hole drilling motors are subjected to a harsh environment involving both higher temperatures, hydrocarbon immersion and dynamic loading. The key here in down hole motors has been to make the elastomer property soft enough for injection molding and soft enough to maintain the sealed cavity, yet be hard enough to be able to withstand the abrasive wear from the working contact between the rotor and the stator. U.S. Pat. No. 5,620,313, entitled "Worm Pump For Flowable Media," utilizes a stator wall composed of a rubber with a Shore A hardness of 90 to 95 (tested in accordance with ASTM D2240). Such a hard elastomer property is desirable for withstanding the abrasive wear found in conventional down hole drilling motors. However, such a hard material is difficult to injection mold, resulting in expensive manufacturing costs. Thus, the prior art has not been able to achieve a satisfactory balance for use in down hole motors, regarding durability in operation but easier to manufacture.

Additionally, drilling applications generally involve high-temperature environments. U.S. Pat. No. 6,183,226 teaches that rubber used as the stator contact surface is not desirable in high-temperature environments because of its low heat conductivity. U.S. Pat. Nos. 6,183,226 and 5,417,281 disclose use of composites formed from fiberglass, resin, and elastomer. Further, as progressive cavity devices increase in diameter or length or both (as in oil and gas drilling applications), flow characteristics to maintain a successful and long-lasting bond of the rubber to steel housing becomes quite difficult. Moreover, where hydrocarbons make up the material to be pumped, such as in oil and diesel-based drilling mud used in some drilling operations, some rubber compounds are known to deteriorate.

SUMMARY OF THE INVENTION

The present invention addresses shortcomings in the field of down hole motors, particularly shortcomings associated with oil drilling applications. An embodiment of the invention comprises a down hole drilling motor comprising a tubular housing and a stator disposed in the tubular housing. The stator disposed in the tubular housing includes a central cavity. A rotor is operatively positioned in the cavity to cooperate with the lobe. The stator comprises at least one lobe, and preferably a plurality of lobes, that define at least a portion of the cavity. A lobe is formed from a compound that comprises nitrile rubber. The nitrile rubber preferably has about 35 percent by weight acrylonitrile (ACN) by Kjeldahl method and has a Mooney viscosity (tested in accordance with ASTM standard D1646) of about 50 (the nitrile rubber those characteristics is also identified herein as: 35-5 NBR). Preferably a substantial portion of the stator is formed from the compound. In one embodiment, the stator compound comprises about 100 parts by weight of the 35-5 NBR per about 231.5 total parts per weight. Conventional ingredients typically account for the remainder of the 231.5 parts.

A compound according to an embodiment of the present invention suitable for a drilling motor has a hardness (Shore A), tested in accordance with ASTM Standard D2240, less than 90, and preferably in a range of about 70–75. The compound preferably has a volume percent change less than 10 percent when subjected to a 72 hour 300 degree Fahrenheit test in accordance with ASTM Standard D471 using Versadrill™ drilling fluid. Similarly, the compound preferably has a volume percent change less than 5 percent when subjected to a test with similar test parameters except using sodium silicate.

The present invention provides an improved stator for a dynamic down hole drilling motor wherein the stator has improved thermal degradation characteristics. The invention provides a down hole motor with reduced susceptibility to stator damage from the rotor due to water swell of the stator. The preset invention provides a down hole motor with improved sealing characteristics and sufficient wear characteristics.

Additionally, the present invention reduces down hole motor manufacturing costs associated with injection-molding the rubber stator while improving rubber-to-model metal bonding characteristics. The present invention improves the wear and performance characteristics of the down hole drilling motor by providing better rubber-to-metal bonding characteristics.

DETAILED DESCRIPTION OF THE ILLUSTRATED EMBODIMENT

Figure 1:
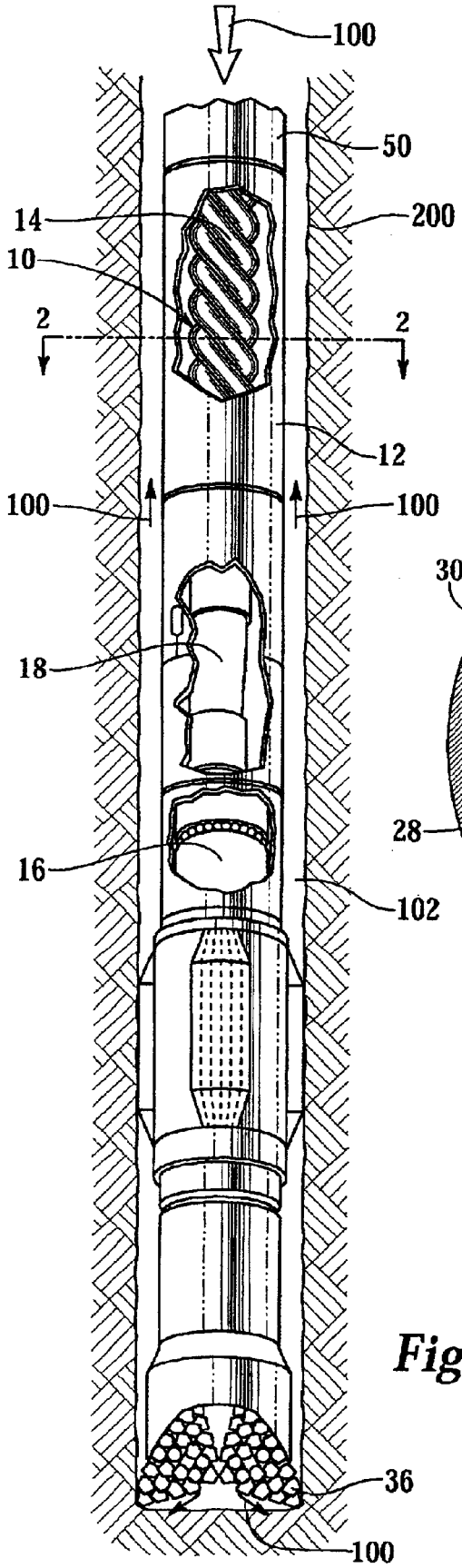
FIG. 1 illustrates a side view of a down hole drilling motor of the present invention with the portions of the tubular housing cut away for purposes of illustrating internal features.
Figure 2:
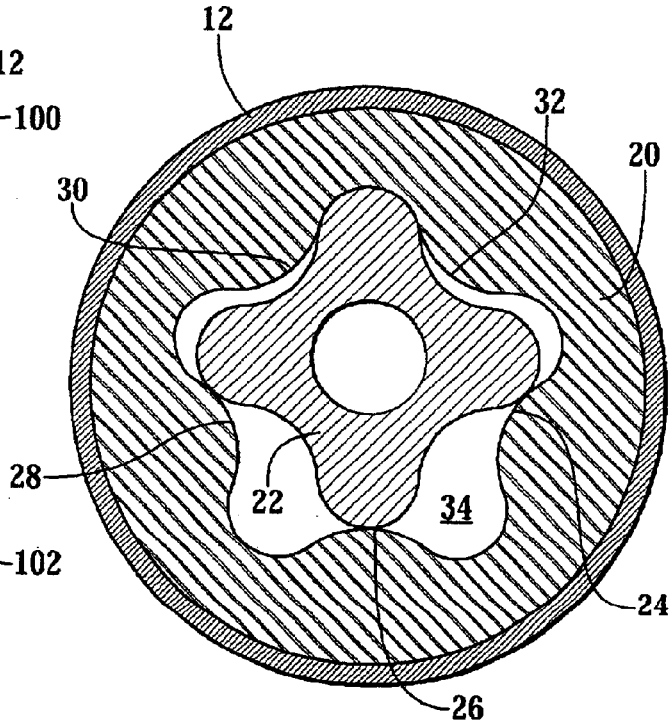
FIG. 2 is a cross-section view showing a rotor operatively positioned in a cavity defined by a stator, wherein the stator is disposed in a tubular housing.

FIG. 1 depicts a down hole motor 10 according to one embodiment of the present invention. A down hole motor generally comprises a tubular housing 12 that is preferably formed of steel. Disposed within the tubular housing 12 is a power unit 14 connected to a bearing section assembly 16 via a transmission unit 18. The power unit 14 comprises a stator 20 and rotor 22, a cross-section of which is shown in FIG. 2. The stator preferably comprises a plurality of lobes (24, 26, 28, 30, 32) defining a cavity 34. It will be understood by those skilled in the art that there may be fewer or more lobes than the 5 illustrated herein. The rotor 22 is operatively positioned in the cavity 34 to cooperate with the plurality of lobes. Applying fluid pressure to the cavity 34 causes the rotor 22 to rotate in cooperation with the lobes in order to allow pressurized drilling fluid 100 that is introduced at an upper end of the pump to be expelled at the lower end and then subsequently exhausted from the bit 36. Rotation of rotor 22 causes drill teeth 36 to rotate.

In operation, drilling fluid (also known in the art as drilling mud) 100 is pumped down the interior of a drill string 50 (shown broken away) attached to down hole drilling motor 10. Drilling fluid 100 enters cavity 34 having a pressure that is a combination of pressure imposed on the drilling fluid by pumps at the surface and the hydrostatic pressure of the above column of drilling fluid 100. The pressurized fluid entering cavity 34, in cooperation with the lobes of the stator and the geometry of the stator and rotor causes the lobes to the stator to deform and the rotor to turn to allow the drilling fluid 100 to pass through the motor. Drilling fluid 100 subsequently exits through ports (referred to in the art as jets) in drill bit 36 and travels up the annulus 102 between the bit, motor and drill string and is received at the surface where it is captured and pumped down the drill string again.

Down hole drilling motors fall into a general category referred to as Moineau-type motors. For a further discussion of down hole drilling motors and their operations, see U.S. Pat. Nos. 3,840,080, 5,090,497, and 6,183,226 and Canadian Patent No. 2,058,080, incorporated by reference. Down hole motors are, however, generally subjected to greater torquing loads than simple worm pumps that also fall generally into that category. This is particularly true with high power density (HPD) down hole motors used in oil and gas well drilling. Detailed description of Moineau-type motors may be found in U.S. Pat. Nos.: 3,840,080; 3,912,426; 4,415,316; 4,636,151; 5,090,497; 5,171,138; 5,417,281; 5,759,019; and 6,183,226 and Canadian Patent No. 2,058,080. The above-identified U.S. patents are incorporated herein by reference for their teachings concerning Moineau-type motors.

Conventional Moineau pump and motor art has used rubber or elastomer materials bonded to the steel housing for the stator contact surface. However, in dynamic loading conditions, such as is involved in down hole drilling applications, substantial heat is generated in the rubber parts. Since rubber is not a good heat conductor, thermal energy is accumulated in the rubber part. This thermal energy accumulation may lead to thermal degradation and, therefore, damage of the rubber parts and separation from the housing. Drilling operations using HPD down hole motors put more loads on the rubber than traditional down hole motors. Thus, HPD applications result in more heat generated in the rubber. Also, where hydrocarbons make up the material to be pumped, such as in oil-based or diesel-based drilling fluids, rubber is known to deteriorate, such deterioration is exacerbated by the accumulation of thermal energy. Thus, the prior art has taught using composites for the stator rather than rubbers or elastomers. (See U.S. Pat. No. 6,183,226 and Canadian Patent No. 2,058,080).

Even mere water is a problem in drilling applications. For optimum performance of the drilling motor, there is a certain required clearance between the rubber parts of the stator and the rotor. When the rubber swells, not only the efficiency of the motor is comprised but also the rubber is susceptible to damage because of reduced clearance between the rotor and the stator. The reduced clearance induces higher loads on the rubber.

When a rotor is loaded, the rubber lobes of the stator will be deformed. Rubber with a higher modulus, i.e., a stiffer rubber, will recover faster from the deformation, thus providing better sealing during the drilling operation. Stiffer rubber, however, has disadvantages during the manufacturing processing stages. Processibility is generally inversely related to the stiffness of the rubber. This is particularly true in injection-mold processes. The stator in down hole motors are generally formed using an injection mold process. Due to the length and volume of the down hole motor, very high power is required to injection-mold the rubber. Typically, a stiffer compound will demand much more processing power and time, thereby increasing manufacturing costs.

Down hole drilling motors typically utilize a steel metal housing. Therefore, another requirement is that the stator have a good rubber-to-metal bonding strength. If there is not enough bonding strength between the rubber and housing, the rubber will separate from the housing during the operation of the down hole motor. The loading requirements are even more stringent for HPD down hole motor applications.

U.S. Pat. Nos. 6,183,226 and 5,417,281 and Canadian Patent No. 2,058,080 teach utilizing composites rather than rubber to overcome the above-discussed disadvantages of rubber. Despite the teachings of the prior art, an embodiment of the present invention utilizes a compound comprising nitrile rubber having about 35 percent by weight acrylonitrile and a Mooney viscosity of about 50, measured in accordance with ASTM Standard D1646, typically designated 35-5 NBR. In a preferred embodiment the compound comprises about 100 parts by weight of 35-5 NBR per about 231.5 total parts by weight.

TABLE 1

| Compound | | HS-40B |
|---|---|---|
| Tensile Strength (psi) - ASTM D412, Die C | | 2307 |
| Elongation @ Break - ASTM D412, Die C | | 353 |
| Tear Strength (lb/in) - ASTM D624, Die C | | 195 |
| 25% Tensile Modulus (psi) - ASTM D412, Die C | | 228 |
| 50% Tensile Modulus (psi) - ASTM D412, Die C | | 331 |
| 100% Tensile Modulus (psi) - ASTM D412, Die C | | 615 |
| 5% Compression Modulus (psi) - ASTM D575 | | 41 |
| 10% Compression Modulus (psi) - ASTM D575 | | 92 |
| 15% Compression Modulus (psi) - ASTM D575 | | 151 |
| Hardness (Shore A) - ASTM D2240 | | 73.7 |
| Density (gm/cc) - ASTM D1817 | | 1.218 |
| Adhesion Peel Tests - ASTM D429 Method B | | 108 |
| Dynamic Properties | | |
| Temperature | | |
| 60° C. | E' | 12.3 |
| 80° C. | | 10.5 |
| 100° C. | | 9.6 |
| 60° C. | E" | 2.5 |
| 80° C. | | 1.9 |
| 100° C. | | 1.5 |
| 60° C. | tanδ | 0.20 |
| 80° C. | | 0.18 |
| 100° C. | | 0.16 |

TABLE 2

| Water Swell (%) - ASTM D417 | |
|---|---|
| Two Weeks at Room Temperature | 3.3 |
| Volume Change (%) - ASTM D417 | |
| 24 hours at 300° F. | |
| Sodium Silicate | 1.611 |
| KCL Brine - water based mud | −0.076 |
| Versaclean - oil based mud | 0.527 |
| Versadrill - diesel based mud | 9.271 |

TABLE 2-continued

| | |
|---|---|
| 46 hours at 300° F. | |
| Sodium Silicate | 2.418 |
| KCL Brine - water based mud | −0.140 |
| Versaclean - oil based mud | 0.154 |
| Versadrill - diesel based mud | 10.076 |
| 72 hours at 300° F. | |
| Sodium Silicate | 3.883 |
| KCL Brine - water based mud | 0.042 |
| Versaclean - oil based mud | −0.580 |
| Versadrill - diesel based mud | 8.951 |
| 168 hours at 300° F. | |
| Sodium Silicate | 4.086 |
| KCL Brine - water based mud | 0.382 |
| Versaclean - oil based mud | −1.003 |
| Versadrill - diesel based mud | 7.081 |

TABLE 3

| Formulation | HS-40B |
|---|---|
| Nysyn 35-5 | 100 |
| Ultra N774 | 75 |
| Akrochem P55 | 10 |
| 85% ZnO MB | 5 |
| Stearic Acid | 1 |
| TP-95 | 10 |
| DIDP | 10 |
| Cumar R-13 | 10 |
| Naugard 445 | 1.5 |
| Vanox ZMTI | 1.5 |
| 75% Sulfur MB | 4.5 |
| MB Total | |
| 50% PVI MB | 1.8 |
| PB (OBTS)-75 | 1 |
| PB (TMTM)-75 | 0.15 |
| Total | 231.45 |

For convenience a preferred compound suitable for use in an embodiment of the present invention is designated herein as HS-40B. Tables 1 and 2 list characteristic properties of the HS-40B compound. Table 1 lists various mechanical properties and Table 2 lists various structural property. Table 2 lists the percent change in volume based on soaking the compound in various mediums. Table 3 lists one preferred formulation for the HS-40B compound.

TABLE 4

| Versadrill Drilling Mud | 72 Hrs. @ 300° F. | | 168 Hrs. @ 300° F. |
|---|---|---|---|
| Property | Original | % Change | % Change |
| NBR-1 | | | |
| Tensile Strength (psi) | 2003 | −51.4 | −53.0 |
| Elongation @ Break (%) | 400 | −23.3 | −19.3 |
| Tear (lb/in) | 241 | −35.3 | −53.5 |
| 50% Tensile Modulus (psi) | 285 | −42.5 | −40.4 |
| 100% Tensile Modulus (psi) | 466 | −40.3 | −37.3 |
| 10% Compression Modulus (psi) | 88 | −37.5 | −36.2 |
| Hardness (Shore A) | 74 | −20.3 | −20.0 |
| Density (gm/cc) | 1.189 | −3.0 | −4.5 |
| Volume (cu. in.) | 0.479 | 14.6 | 17.7 |
| NBR-2 | | | |
| Tensile Strength (psi) | 2004 | −42.6 | −43.1 |
| Elongation @ Break (%) | 477 | −8.8 | −2.7 |

TABLE 4-continued

| Versadrill Drilling Mud | 72 Hrs. @ 300° F. | | 168 Hrs. @ 300° F. |
|---|---|---|---|
| Property | Original | % Change | % Change |
| Tear (lb/in) | 262 | −45.4 | −43.9 |
| 50% Tensile Modulus (psi) | 276 | −63.4 | −64.9 |
| 100% Tensile Modulus (psi) | 504 | −63.9 | −65.1 |
| 10% Compression Modulus (psi) | 68 | −45.6 | −45.5 |
| Hardness (Shore A) | 73 | −27.4 | −27.0 |
| Density (gm/cc) | 1.240 | −4.8 | −4.5 |
| Volume (cu. in.) | 0.480 | 19.8 | 19.1 |
| HS-40B | | | |
| Tensile Strength (psi) | 2307 | −15.5 | −18.7 |
| Elongation @ Break (%) | 353 | −10.2 | −17.7 |
| Tear (lb/in) | 195 | −29.3 | −28.8 |
| 50% Tensile Modulus (psi) | 331 | −19.5 | −15.6 |
| 100% Tensile Modulus (psi) | 615 | −17.0 | −12.0 |
| 10% Compression Modulus (psi) | 87 | −11.2 | −8.3 |
| Hardness (Shore A) | 74 | −7.4 | −4.6 |
| Density (gm/cc) | 1.216 | −2.5 | −2.3 |
| Volume (cu. in.) | 0.480 | 9.0 | 7.1 |

TABLE 5

| Sodium Silicate Drilling Mud | 72 Hrs. @ 300° F. | | 168 Hrs. @ 300° F. |
|---|---|---|---|
| Property | Original | % Change | % Change |
| NBR-1 | | | |
| Tensile Strength (psi) | 2003 | −45.6 | −44.0 |
| Elongation @ Break (%) | 400 | −51.9 | −48.7 |
| Tear (lb/in) 241 | −52.7 | −56.9 | |
| 50% Tensile Modulus (psi) | 285 | 4.4 | −1.0 |
| 100% Tensile Modulus (psi) | 466 | 16.2 | 15.8 |
| 10% Compression Modulus (psi) | 98 | 4.8 | −9.2 |
| Hardness (Shore A) | 73 | −8.2 | −12.1 |
| Density (gm/cc) | 1.193 | −0.75 | −0.70 |
| Volume (cu. in.) | 0.478 | 9.45 | 11.83 |
| NBR-2 | | | |
| Tensile Strength (psi) | 2004 | −51.9 | −51.9 |
| Elongation @ Break (%) | 477 | −71.8 | −74.4 |
| Tear (lb/in) | 262 | −56.3 | −62.9 |
| 50% Tensile Modulus (psi) | 276 | 33.8 | −44.3 |
| 100% Tensile Modulus (psi) | 504 | 45.1 | 54.8 |
| 10% Compression Modulus (psi) | 67 | 21.5 | 19.5 |
| Hardness (Shore A) | 74 | −5.0 | −11.0 |
| Density (gm/cc) | 1.239 | −1.30 | −1.62 |
| Volume (cu. in.) | 0.479 | 9.94 | 14.06 |
| HS-40B | | | |
| Tensile Strength (psi) | 2307 | −19.8 | −19.7 |
| Elongation @ Break (%) | 353 | −38.9 | −37.3 |
| Tear (lb/in) | 195 | −32.1 | −34.2 |
| 50% Tensile Modulus (psi) | 331 | −36.2 | 38.4 |
| 100% Tensile Modulus (psi) | 615 | 43.9 | 43.4 |
| 10% Compression Modulus (psi) | 92 | 13.4 | 18.1 |
| Hardness (Shore A) | 74 | 0.5 | −1.6 |
| Density (gm/cc) | 1.218 | −0.02 | 0.36 |
| Volume (cu. in.) | 0.480 | 3.88 | 4.09 |

TABLE 6

| Initial Wt. (gm) | Swollen Wt. (gm) | Dry Wt. (gm) | Swell % | Abstract % |
|---|---|---|---|---|
| NBR-1 | XYLENE | | | |
| Nov. 17, 1998 | Nov. 27, 1998 | Dec. 16, 1998 | | |
| 0.399 | 0.655 | 0.33 | 98.5 | 17.3 |

TABLE 6-continued

| Initial Wt. (gm) | Swollen Wt. (gm) | Dry Wt. (gm) | Swell % | Abstract % |
|---|---|---|---|---|
| 0.406 | 0.67 | 0.336 | 99.4 | 17.2 |
| 0.402 | 0.657 | 0.332 | 97.9 | 17.4 |
| 0.399 | 0.656 | 0.327 | 100.6 | 18.0 |
| | | | 99.1 | 17.5 |
| NBR-2 | XYLENE | | | |
| Nov. 17, 1998 | Nov. 27, 1998 | Dec. 16, 1998 | | |
| 0.442 | 0.749 | 0.365 | 105.2 | 17.4 |
| 0.438 | 0.742 | 0.362 | 105.0 | 17.4 |
| 0.438 | 0.739 | 0.36 | 105.3 | 17.8 |
| 0.445 | 0.755 | 0.369 | 104.6 | 17.1 |
| | | AVG. | 105.0 | 17.4 |
| HS-40B | XYLENE | | | |
| Jan. 8, 1999 | Jan. 14, 1999 | Jan. 25, 1999 | | |
| 0.423 | 0.634 | 0.354 | 79.1 | 16.3 |
| 0.437 | 0.657 | 0.365 | 80.0 | 16.5 |
| 0.445 | 0.668 | 0.373 | 79.1 | 16.2 |
| 0.435 | 0.653 | 0.366 | 78.4 | 15.9 |
| | | AVG. | 79.1 | 16.2 |

TABLE 7

| Initial Wt. (gm) | Swollen Wt. (gm) | Dry Wt. (gm) | Swell % | Abstract % |
|---|---|---|---|---|
| NBR-1 | WATER | | | |
| Dec. 3, 1998 | Dec. 18, 1998 | Dec. 22, 1998 | | |
| 0.411 | 0.415 | 0.402 | 3.2 | 2.2 |
| 0.4 | 0.405 | 0.394 | 2.8 | 1.5 |
| 0.399 | 0.403 | 0.39 | 3.3 | 2.3 |
| 0.406 | 0.418 | 0.398 | 5.0 | 2.0 |
| | | | 3.6 | 2.0 |
| NBR-2 | WATER | | | |
| Dec. 3, 1998 | Dec. 18, 1998 | Dec. 22, 1998 | | |
| 0.431 | 0.469 | 0.411 | 14.1 | 4.6 |
| 0.436 | 0.481 | 0.413 | 16.5 | 5.3 |
| 0.429 | 0.472 | 0.407 | 16.0 | 5.1 |
| 0.424 | 0.461 | 0.405 | 13.8 | 4.5 |
| | | AVG. | 15.1 | 4.9 |
| HS-40B | WATER | | | |
| Jan. 8, 1999 | Jan. 14, 1999 | Jan. 25, 1999 | | |
| 0.419 | 0.422 | 0.409 | 3.2 | 2.4 |
| 0.434 | 0.438 | 0.422 | 3.8 | 2.8 |
| 0.427 | 0.432 | 0.42 | 2.9 | 1.6 |
| 0.437 | 0.441 | 0.426 | 3.5 | 2.5 |
| | | AVG. | 3.3 | 2.3 |

Tables 4–7 show comparisons between HS-40B, which comprises NBR, and other NBR motor compounds, generically designated NBR 1 and NBR 2. Table 4 shows a comparison and Versadrill™ drilling mud which is a diesel based mud. Table 5 shows a comparison in sodium silicate mud. Tables 6 and 7 show the result of subjecting the NBR compounds to Xylene and water swell tests per ASTM Standard D471, respectively. The NBR 1 and NBR 2 were chosen for their comparable hardness (Shore A) characteristic per ASTM Standard D2240. Reference to Tables 4 and 5 will show that the HS-40B percent change in volume was less than half that of the NBR compounds with comparable hardness characteristics.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

I claim:

1. A down hole drilling motor for well drilling operations including:

a tubular housing;

a stator disposed in the tubular housing, said stator having an internal cavity passing therethrough, wherein the stator includes one or more lobes defining at least a portion of the cavity;

a rotor operatively positioned in the cavity to cooperate with the one or more lobes of the stator; and wherein the improvement comprises the one or more lobes being formed from a compound comprising nitrile rubber having about 35% by weight acrylonitrile and a Mooney viscosity of about 50% (35-5 NBR).

2. The down hole drilling motor of claim 1, wherein the tubular housing comprises metal and the stator is bonded to the housing.

3. The down hole motor of claim 1, wherein the metal is steel and the stator is bonded to the steel.

4. The down hole motor of claim 1, wherein a substantial portion of the stator and the one or more lobes is comprised of the compound.

5. The down hole motor of claim 1, wherein the compound comprises about 100 parts by weight of the 35-5 NBR per about 231.5 total parts by weight.

6. A stator for use in a down hole drilling motor for use in well drilling operations including a tubular housing, wherein the stator comprises one or more lobes defining at least a portion of a cavity adapted to receive a rotor and wherein the improvement comprises the stator being formed from a compound comprising nitrile rubber having about 35% by weight acrylonitrile and a Mooney viscosity of about 50 (35-5 NBR).

7. The stator of claim 6, wherein the compound comprises about 100 parts by weight of the 3-55 NBR per 231.5 total parts by weight.

8. A down hole drilling motor for use in well drilling applications, the motor including:

a tubular housing; and a stator disposed in the housing, said stator having an internal cavity;

a rotor disposed in said cavity in said stator;

wherein the improvement comprises the stator being formed from a compound having structural properties of:

a tensile strength of about 2300 psi;

an elongation at break of about 350%;

a tear strength of about 195 lb/in;

a 25% tensile modulus of about 230 psi;

a 50% tensile modulus of about 330 psi; a 100% tensile modulus of about 620 psi; and a hardness of about 75 Shore A.

9. The motor of claim 8, wherein the stator further comprises structural properties of:

a 5% compression modulus of about 40 psi;

a 10% compression modulus of about 90 psi; and a 15% compression modulus of about 150 psi.

10. A down hole drilling motor for use in oil and gas well drilling applications, the motor comprising:

a tubular housing;

a stator disposed in the housing, said stator having an internal cavity therein;

a rotor disposed in said internal cavity of said stator; wherein the improvement comprises the stator being formed from an improved compound having dynamic structural properties of:

an E' at 60° C. of about 12.3;

an E" at 60° C. of about 2.5; and a tan δ at 60° C. of about 0.20.

11. The motor of claim 10, wherein the stator comprises a hardness measurement of about 75 Shore A.

12. A down hole drilling motor for use in fluid drilling applications, the motor comprising:

a tubular housing; and a stator disposed in the housing, an internal cavity being in said stator;

a rotor disposed in said cavity in said stator;

wherein the improvement comprises a stator being formed from an improved compound of:

nitrile rubber having about 35% by weight acrylonitrile and a Mooney viscosity of about 50;

wherein the compound has a hardness measurement less than 90 Shore A.

13. A method of manufacturing a down hole motor, the method comprising:

injection-molding a stator into a tubular housing, having an internal cavity, with one or more lobes defining said cavity, said stator being formed from a compound;

wherein the improvement comprises forming the compound from a nitrile rubber having about 35% by weight acrylonitrile and the compound has a hardness measurement less than 90 Shore A.

14. The method of claim 13, wherein the nitrile rubber used in the compound has a Mooney viscosity of about 50.

15. A method of operating a down hole drilling motor in a well drilling application, the method comprising:

loading a rotor positioned in an internal cavity in a stator, wherein said cavity has one or more lobes therein;

allowing lobes of the stator to deform;

maintaining a predetermined clearance between the lobes of the stator and the rotor, wherein the lobes of the stator are formed from a compound comprising nitrile rubber having about 35% by weight acrylonitrile and the compound has a hardness measurement of less than 90 Shore A.

16. The method of claim 15, wherein the nitrile rubber has a Mooney viscosity of about 50.

17. A method of improving down hole drilling motor performance characteristics, the method comprising:

providing a tubular housing for said down hole motor, and injection-molding a stator formed from an improved rubber compound into the housing, wherein the improved compound comprises nitrile rubber having about 35% by weight acrylonitrile and the compound has a hardness measurement less than about 90 Shore A.

18. The method of claim 17, wherein the nitrile rubber has a Mooney viscosity of about 50.

19. A method of operating a down hole drilling motor in a well drilling operation, the method including the steps of:

introducing a drilling fluid into a first end of a down hole drilling motor;

loading a rotor positioned in a stator by passing drilling fluid introduced at the first end of said motor through a cavity between one or more lobes of a stator formed from an improved compound;

allowing the stator to deform;

wherein the improvement comprises forming the stator from an improved compound of nitrile rubber having about 35% by weight acrylonitrile and a hardness measurement less than about 90 Shore A.

20. The method of claim 19, wherein the nitrile rubber has a Mooney viscosity of about 50.

* * * * *